United States Patent [19]

Morton et al.

[11] Patent Number: 4,609,797

[45] Date of Patent: Sep. 2, 1986

[54] SPLITTER PLATE

[75] Inventors: John S. Morton, Wilmslow; James F. Parkinson, Rochdale, both of Great Britain

[73] Assignee: Whipp & Bourne Limited, Rochdale, England

[21] Appl. No.: 662,414

[22] PCT Filed: Jan. 23, 1984

[86] PCT No.: PCT/GB84/00018

§ 371 Date: Sep. 26, 1984

§ 102(e) Date: Sep. 26, 1984

[87] PCT Pub. No.: WO84/03004

PCT Pub. Date: Aug. 2, 1984

[30] Foreign Application Priority Data

Jan. 31, 1983 [GB] United Kingdom ..... 8302615

[51] Int. Cl.[4] ..... H01H 33/08

[52] U.S. Cl. ..... 200/144 R; 200/144 C; 200/147 R; 200/147 B

[58] Field of Search ..... 200/147 B, 147 R, 144 R, 200/144 C

[56] References Cited

U.S. PATENT DOCUMENTS

| | | | |
|---|---|---|---|
| 2,934,629 | 4/1960 | Bonnefois et al. | 200/147 B |
| 3,641,294 | 2/1972 | Armitage et al. | 200/144 R |
| 4,405,847 | 9/1983 | Morton | 200/147 R |

FOREIGN PATENT DOCUMENTS

| | | |
|---|---|---|
| 2624957 | 11/1977 | Fed. Rep. of Germany . |
| 1124186 | 6/1956 | France . |
| 1309965 | 10/1962 | France . |
| 2348559 | 11/1977 | France . |

*Primary Examiner*—Robert S. Macon

*Attorney, Agent, or Firm*—Solon B. Kemon

[57] ABSTRACT

An arc splitter plate made of steel includes a pair of spaced parallel limbs which merge together at one end into a block forming a notch therebetween. Toward an end portion of the block remote from the notch is an insulated region which extends across a portion of a first face of the block, over a leading edge of the block, and onto a second face of the block. The insulated region is formed from an insulating means which is made from a tape including combined layers of an insulating material and an adhesive. The arc splitter plates are for use in arc chutes and more especially for use in cold cathode arc chutes.

5 Claims, 3 Drawing Figures

SPLITTER PLATE

DESCRIPTION

This invention relates to arc splitter plates for use in arc chutes and more especially to arc splitter plates for use in cold cathode arc chutes.

According to the invention, there is provided an arc splitter plate characterised in having a pair of spaced parallel limbs merging into a block portion, the block portion including at an end region thereof remote from the pair of spaced parallel limbs an insulating means formed as a continuous strip of flexible material adhering to a surface of the block portion.

Embodiments of the invention will now be described by way of example, and with reference to the accompanying partially diagramatic drawings in which.

Figure 1:
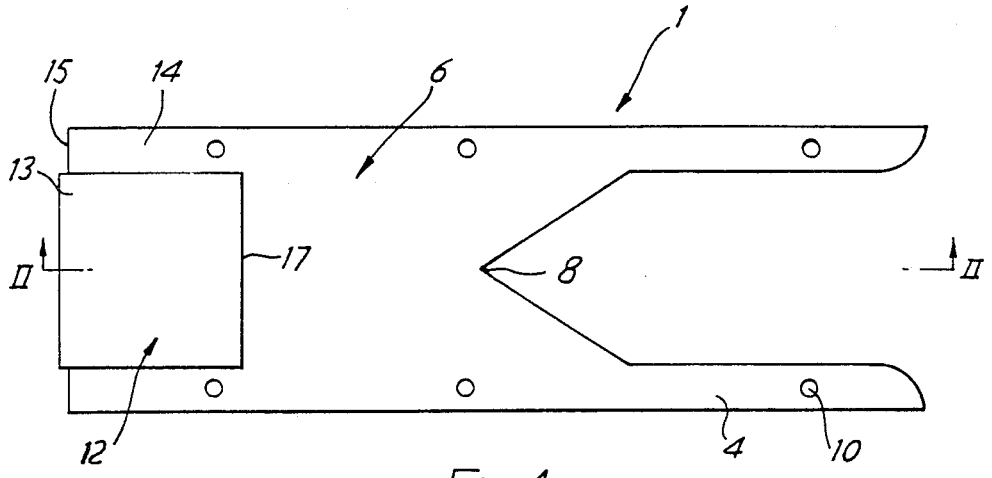
FIG. 1 is a plan view of an arc splitter plate.
Figure 2:
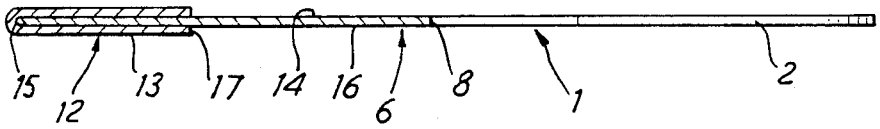
FIG. 2 is a cross-sectional elevation of the arc splitter plate taken along the line 11—11 of FIG. 1.

With reference to FIGS. 1 and 2 of the drawings, an arc splitter plate 1 made of steel includes a pair of spaced-parallel limbs 2, 4 of rectangular cross section which merge together at one end into a block 6 of rectangular cross-section forming a notch 8, therebetween in one end portion of the block 6. Spaced along each limb 2, 4 and opposed edge regions of the block 6 are a series of aligning apertures 10. Toward another end portion of the block 6, remote from the notch 8, is an insulated region 12 which extends across a portion of the width of a first face 14 of the block 6 and extends over a leading edge 15 of the block 6 remote from the free ends of the pair of limbs 2, 4 to a second face 16 of the block 6, mutually opposed to the first face 14 of the block 6.

The insulated region 12 is formed from an insulating means 13 which comprises a tape 13 including combined layers of insulating material and adhesive, for example, a layer of polyimide insulating material and a layer of silicon adhesive.

The tape 13 is applied to the first and second faces 14, 16 of the block 6, prior to assembly of the arc splitter plate 1 into an arc chute. The tape 13 is applied from a dispenser containing a reel of tape 13 of appropriate width, the width of the tape 13 being in the range of 50 to 100 mm. The tape 13 including combined layers having a thicknes in the range of 0.05 to 0.5 mm of polyimide insulating material and silicon adhesive. The tape 13 is applied to the first face 14 of the block 6, which has previously been cleared to remove dirt and grease, drawn over the leading edge 15, and applied to the second face 16, which also has been previously cleaned to remove dirt and grease, to form the insulated region 12 of a length of, for example, 100 mm on faces 14, 16, leaving an exposed region of steel of, for example, 150 mm in length between the insulated region 12 and the notch 8 on opposed faces 14, 16 of the block 6. These dimensions varying in dependence upon the current being interrupted and the voltage rating of the arc chute.

Figure 3:
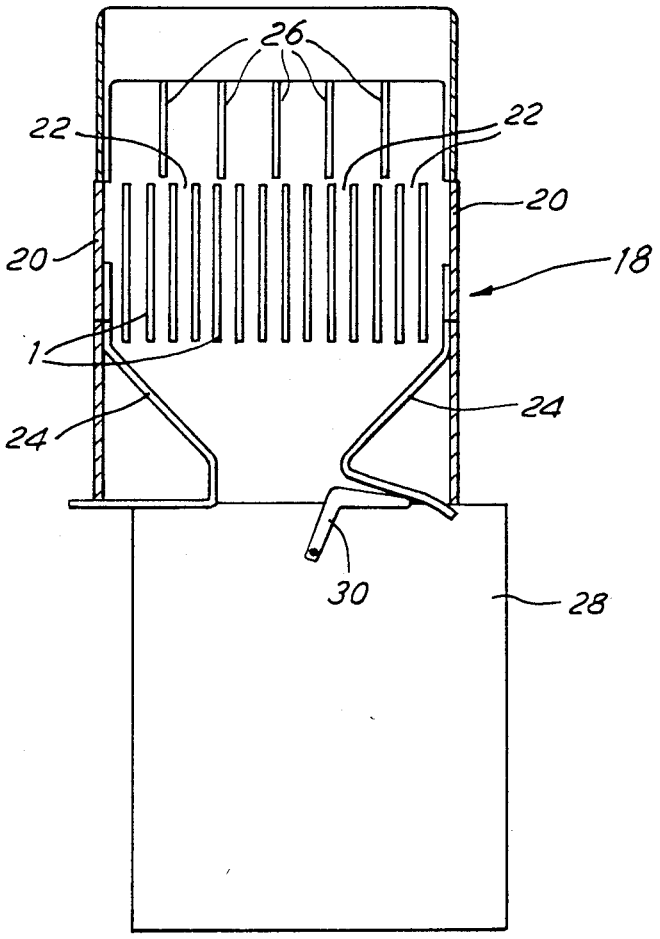
FIG. 3 is a part sectional elevation of a cold cathode arc chute including a number of arc splitter plates and circuit breaker.

With reference to FIG. 3, a number of such arc splitters plates 1 are then assembled into a cold cathode arc chute 18. The cold cathode arc chute 18 includes a pair of spaced supports 20, each support 20 supporting one of the limbs 2, 4 of each of the arc splitter plates by means of fixing elements (not shown) inserted through the apertures 10 in the arc splitter plates 1 such that the notches 8 of the arc splitter plates 1 form a tunnel between the supports 20. The arc splitter plates are arranged with spacers (not shown) made of insulating material so that a row of narrow arc extinguishing compartments 22 is produced each having an open top. A pair of runners 24 is positioned to extend along the tunnel, and vent spacer plates 26 are positioned above the open tops of the arc extinguishing compartments 22. The assembled arc chute 18 is then mounted on a circuit breaker 28 so that the pair of runners 24 engage with an arc initiating device 30 on the circuit breaker 28.

In operation, an arc initiated by the circuit breaker 28 is caused to propogate along the pair of runners 24 and is then caused to enter the arc extinguishing compartments 22 by the shape of the arc splitter plates 1 and the presence of a magnetic field generated by the arc itself. At the notch 8 the presence of the magnetic field is mitigated and the arc is broken down into a number of separate series arcs each of which roots on the exposed regions of opposed faces 14, 16 of the block 6 of the arc splitter plates forming the walls of the arc extinguishing compartments 22. The splitting of the arc into a number of series arcs producing a multiple voltage drop at the root of each series arc. The series arcs which root to the exposed region of each block 6 of each arc splitter plate 1 traverse along the exposed regions of the block 6 up to an edge 17 of the tape 13 remote from the leading edge 15 of the block 6. The series arcs may be maintained within these exposed regions until arc extinguishing is required. Arc extinguishing is achieved by maintaining sufficient arc voltage so that the resultant arc resistance increases and forces the current to zero. The series arcs are prevented from escaping from the arc chute 18 by the presence of the tape 13 and ionized gas produced during the propogation and traversing of the series arcs passes through the space between the two arc splitter plates 1 forming each arc extinguishing compartment 22 to deionize the gas so that a restrike of the series arcs above the open tops of the arc extinguishing compartments 22 is prevented. The deionized gas is then vented through the open top of each of the arc extinguishing compartments 22, and directed between the vent spacer plates 26 and so out of the arc chute 18.

The presence of the tape 13 prevents the series arc roots from traversing to the leading edge 15 of the block 6 where the separate series arcs would then be able to join up to become one arc extending over the open tops of the arc extinguishing compartments 22. Thus, tape 13 must be able to withstand the effects of arcing including a high temperature in the range of 2000° to 5000° C. and, the impact of a high impulse of energy. The thicker the tape 13 then the more capable it is of withstanding the effects of arcing, hence prolonging the useful life of the arc splitter plate 1.

However, if the tape is too thick, for example, in the range of 0.75 to 1.0 mm then the space between the two arc splitter plates forming the arc extinguishing compartments 22 is reduced in the insulated region 12 covered by the tape 13 and this reduces the space between the arc splitter plates 1 available for deionizing the ionized gas and for venting the gas thus creating a build up of deionized gas at the top of the arc extinguishing compartments 22 which could force the series arcs down the arc chute 18 toward the circuit breaker 28. Alternatively, if the tape is too thin, for example, in the range of 0.01 to 0.05 mm then the space between the two arc splitter plates 1 forming the arc extinguishing compartments 22 is increased in the insulated region 12 covered by the tape 13 and this increases the space between the arc splitter plates 1 available for deionizing the gas, if this is combined with a reduction in the area of the block 6 covered by tape 13 to, for example, a length of 30 mm then a substantial quantity of ionized gas may be vented through the open top of the arc extinguishing compartments 22 thereby allowing a possibility of a restrike of the series arcs across the open tops of the arc extinguishing compartments 22. Hence, a compromise is taken, determined empirically, between the thickness of the tape 13 and the arc splitter plate 1 spacing at the insulated region 12 covered by the tape 13, and the area of the block 6 covered by the tape 13. Typically, tapes having a thickness in the range of 0.05 to 0.5 mm and a spacing between the arc splitter plates 1 of 3 mm at the insulated region 12 together with a length of the block 6 covered by the tape 13 in the range of 50 to 100 mm on each face 14, 16 of the block 6, have been found to be suitable to cause deionization of the gas, and to have prevented the series arcs from propogating to the leading edge 15 of the block 6.

Although in preceding paragraphs only one piece of tape 13 has been applied to each arc splitter plate 1 more than one piece of tape may be applied to each arc splitter plate 1 provided that the joints between the pieces of tape 13 are lap joints.

Further, although in preceding paragraphs the tape 13 has been applied as a combined layer of insulating material and a layer of adhesive, the tape 13 may be applied as separate layers, a layer of insulating material being applied over a layer of adhesive.

Also, other suitable compositions for the layer of insulating material of the tape 13, in addition to polyimide, are various classes of polytetrafluoroethylene (PTFE) reinforced with glass.

Further, the leading edge 15 of the block 6 may be rounded so as to provide improved adhesion of the tape 13.

We claim:

1. An arc splitter plate having a pair of spaced parallel limbs merging into a block poriton, the block portion including at an end region thereof, remote from the pair of spaced paralled limbs, an insulating means, said insulating means being a tape of flexible material adhering to a surface of the block portion, said tape including combined layers of insulating material and adhesive.

2. An arc splitter plate as claimed in claim 1, in which more than one strip of the tape is applied to the block portion, the strips being connected together on the block portion by lap joints.

3. An arc splitter plate as claimed in claim 2, in which the tape is applied to a first face of the block portion, drawn over a leading edge of the block portion, and applied to a second face of the block portion mutually opposed to the first face of the block portion.

4. An arc splitter plate as claimed in claim 1, in which the insulating material is polytetrafluoroethylene reinforced with glass.

5. An arc splitter plate as claimed in claim 1, in which the insulating material is a polyimide and the adhesive is silicon.

* * * * *